US006854671B2

(12) United States Patent
Aizawa et al.

(10) Patent No.: US 6,854,671 B2
(45) Date of Patent: Feb. 15, 2005

(54) NOZZLE FOR EJECTING MOLTEN METAL

(75) Inventors: Jyunichi Aizawa, Tokyo (JP); Hiroshi Fukumoto, Tokyo (JP); Yasufumi Nakasu, Tokyo (JP)

(73) Assignee: Mitsubishi Denki Kabushiki Kaisha, Tokyo (JP)

( * ) Notice: Subject to any disclaimer, the term of this patent is extended or adjusted under 35 U.S.C. 154(b) by 219 days.

(21) Appl. No.: 10/277,081

(22) Filed: Oct. 22, 2002

(65) Prior Publication Data

US 2003/0205628 A1 Nov. 6, 2003

(30) Foreign Application Priority Data

May 1, 2002 (JP) ..... 2002-129757

(51) Int. Cl.[7] ..... B05B 1/14

(52) U.S. Cl. ..... 239/590; 239/594; 239/592; 239/601

(58) Field of Search ..... 239/589, 590, 239/591, 592, 594, 595, 596, 599, 601; 164/461, 463

(56) References Cited

U.S. PATENT DOCUMENTS 4,475,583 A * 10/1984 Ames ..... 164/423
4,719,963 A * 1/1988 Schenk et al. ..... 164/461
5,063,988 A * 11/1991 Follstaedt et al. ..... 164/463
5,171,360 A * 12/1992 Orme et al. ..... 164/46
6,213,356 B1 4/2001 Nakasu et al.
6,306,467 B1 * 10/2001 White et al. ..... 427/470

FOREIGN PATENT DOCUMENTS

| | | |
|---|---|---|
| JP | 61-141565 | 6/1986 |
| JP | 62-257750 | 11/1987 |
| JP | 3-60036 | 3/1991 |
| JP | 3-138942 | 6/1991 |
| JP | 11-274204 | 10/1999 |
| JP | 2002-43351 | 2/2002 |

* cited by examiner

*Primary Examiner*—Dinh Q. Nguyen
(74) *Attorney, Agent, or Firm*—Leydig, Voit & Mayer, Ltd.

(57) ABSTRACT

A nozzle ejects molten metal in an ejecting direction. The nozzle has a solder-philic surface in a first region and a solder-repellent surface in a second region. The second region is located forward of the first region in the ejecting direction. Before molten metal is ejected, the peripheral edge of the liquid surface of the molten metal is held at a position located further forward in the ejecting direction than the boundary between the solder-philic surface and the solder-repellent surface. The peripheral edge of the liquid surface is thus held before being ejected so that solder drops can be ejected steadily with a uniform diameter, constant direction, and constant speed.

13 Claims, 14 Drawing Sheets

$$\sigma' = \sigma \sin \phi$$

NOZZLE FOR EJECTING MOLTEN METAL

BACKGROUND OF THE INVENTION

1. Field of the Invention

The present invention relates to a technique for ejecting molten metal, which can be applied to a technique for ejecting solder in given amounts, for example.

2. Description of the Background Art

Techniques for ejecting solder in given amounts have conventionally been suggested. For example, Japanese Patent Application Laid-Open Nos. 62-257750 (1987) and 3-138942 (1991) disclose techniques for ejecting molten solder from a nozzle by applying pressure to the molten solder, and Japanese Patent Application Laid-Open No. 3-60036 (1991) discloses a technique for drawing out conductive paste from a nozzle with an electrostatic force.

FIG. 23 is a cross-sectional view illustrating the structure of a nozzle 200 of a device for forming solder bumps. The nozzle 200 has a molten solder chamber 1 and a straight portion 5 communicating therewith. A molten solder 20 is stored in the molten solder chamber 1. A pressure P is applied to the molten solder 20 from the side opposite to the straight portion 5 to eject a solder drop 11 from an opening 3 of the straight portion 5 at the side of the molten solder chamber 1. The nozzle 200 is made of stainless steel with poor wettability with respect to solder. This technique is disclosed in Japanese Patent Application Laid-Open No. 11-274204 (1999), for example.

FIGS. 24 to 26 are cross-sectional views showing the structure of a nozzle 201 described in Japanese Patent Application Laid-Open No. 2002-43351 by the applicant of this disclosure, where the reference characters are original to this specification. The nozzle 201 has a tapered portion 6 which spreads wider toward the molten solder chamber 1 and a straight portion 5 which communicates from the tapered portion 6 to a nozzle exit surface 4. The tapered portion 6 has edges 6*a* and 6*b* which adjoin the straight portion 5 and the molten solder chamber 1, respectively. The straight portion 5 has an opening 3 at the nozzle exit surface 4. The nozzle 201, too, is made of a solder-repellent material.

Molten solder 20 is supplied from a passage not shown and stored between the molten solder chamber 1 and a diaphragm 7 covering it. A force F is applied to the molten solder 20 from a stress source not shown, e.g. a piezoelectric device, through the diaphragm 7 that is variable in shape.

The tapered portion 6 is formed at such an angle that the molten solder 20 comes into the tapered portion 6 even when the inner surface of the nozzle 201 is solder-repellent or even when the force F is absent. For example, the tapered portion 6 is formed of the side of a frustum of a circular cone formed around an axis vertical to a bottom surface 1*a* of the molten solder chamber 1. The side of this frustum forms an angle $\alpha$ with respect to the above-mentioned axis. More specifically, when the contact angle that the molten solder 20 forms with respect to the inner surface of the nozzle 201 is taken as $\theta s$, the angle $\alpha$ is set to be ($\theta s-90°$) or larger. On the other hand, the inner side surface of the straight portion 5 is parallel to this axis and therefore the peripheral edge of the liquid surface of the molten solder 20 (hereinafter referred to simply as "liquid surface") is held at the edge 6*a*.

The force F pushes the molten solder 20 toward the opening 3 and then draws it back into the molten solder chamber 1. With the application of the force F in the reciprocating directions, as shown in FIG. 25, a portion of the molten solder 20 is ejected out of the nozzle 201 as a solder drop 11 through the straight portion 5 and from the opening 3.

Before being ejected, the peripheral edge of the liquid surface of the molten solder 20 is held at the edge 6*a*; however, after being ejected, in reaction to the ejection of the solder drop 11, it is drawn back past the edge 6*a* into the tapered portion 6 (FIG. 26).

Even when the nozzle is made of an easy-to-chip member, e.g., a ceramic, the nozzle 201, having the shorter straight portion 5, can be manufactured by a simpler process than the nozzle 200 having no tapered portion 5.

However, in the nozzle 201, as in the nozzle 200, the inner surface of the molten solder chamber 1 is solder-repellent and therefore the molten solder 20 exhibits poor wettability for the molten solder chamber 1. Accordingly, as shown in FIG. 27, when the molten solder chamber 1 is first charged with the molten solder 20, voids 40 may remain in part of the molten solder chamber 1. Then the voids 40 will be compressed when the diaphragm 7 presses the molten solder chamber 1, which may reduce the pressure applied to the molten solder 20 or cause a time delay, making it difficult to obtain the expected ejecting performance.

SUMMARY OF THE INVENTION

An object of the present invention is to improve the molten metal ejecting performance.

According to the present invention, a nozzle for ejecting a molten metal in an ejecting direction includes: a metal-philic surface (where the molten metal forms a contact angle smaller than 90° with respect to the metal-philic surface); and a metal-repellent surface (where the molten metal forms a contact angle larger than 90° with respect to the metal-repellent surface), the metal-repellent surface being located forward of the metal-philic surface in the ejecting direction. Before ejecting, the nozzle holds the peripheral edge of the liquid surface of the molten metal at a position further forward in the ejecting direction than a boundary between the metal-philic surface and the metal-repellent surface.

Before the molten metal is ejected, the peripheral edge of the liquid surface of the molten metal is thus held so as to prevent timing delay in ejecting the molten metal and variations in the diameter, direction, and speed of the ejected molten metal drops. Furthermore, the molten metal to be ejected from the nozzle can be stored with the metal-philic surface surrounding it, which prevents formation of voids while the molten metal is stored.

These and other objects, features, aspects and advantages of the present invention will become more apparent from the following detailed description of the present invention when taken in conjunction with the accompanying drawings.

DESCRIPTION OF THE PREFERRED EMBODIMENTS

A. Introductory Idea and Basic Idea of the Invention

Japanese Patent Application Laid-Open No. 61-141565 (1986) discloses a technique about an ink ejecting portion in an inkjet printer, where the surface of the portion corresponding to the tapered portion 6 and the straight portion 5 of the nozzle 201 is made hydrophilic and the portion corresponding to the nozzle exit surface 4 is made water-repellent. Now, as an idea introductory to this invention, a structure is now discussed in which the surfaces of the tapered portion 6 and the straight portion 5 of the nozzle 201 are made solder-philic and the portion corresponding to the nozzle exit surface 4 is made solder-repellent. It is defined in this invention that the term "solder-philic surface" means that the solder forms a contact angle smaller than 90° with respect to that surface. On the other hand, when a surface is said to be solder-repellent, it means that the solder forms a contact angle larger than 90° with respect to that surface.

Figure 1:
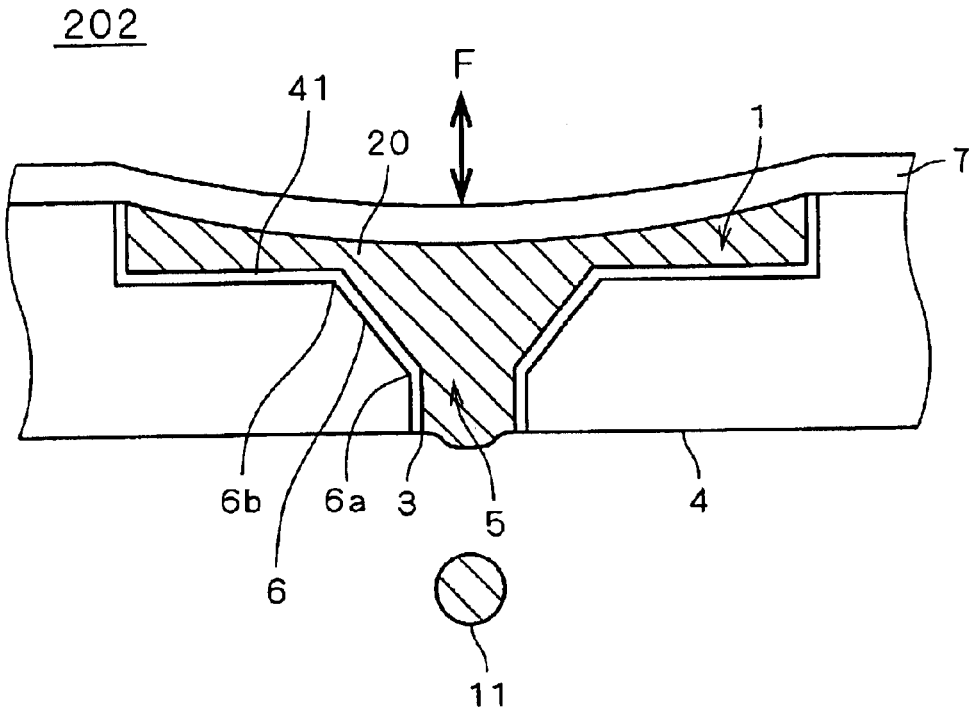
FIGS. 1, 2, 3, 4, 5, and 6 are cross-sectional views showing structures introductory to the present invention.

FIG. 1 is a cross-sectional view showing the structure of a nozzle 202 according to the introductory ideal of this invention. The surfaces of the molten solder chamber 1, the tapered portion 6, and the straight portion 5 are all surface-treated to be solder-philic. More specifically, a plating layer 41 having good wettability for solder is formed, for example. On the other hand, the nozzle exit surface 4 remains solder-repellent.

The molten solder 20 can be easily introduced from the molten solder chamber 1 to the opening 3 since the inner surface of the nozzle 202 is solder-philic. No void 40 will remain in the molten solder chamber 1 when the molten solder chamber 1 is first charged with the molten solder 20.

Before the solder drop 11 is ejected, the peripheral edge of the liquid surface is held at the opening 3, while, in the nozzle 201, it was held at the edge 6*a* of the tapered portion 6. This is because the molten solder 201 easily penetrates into the opening 3 since the surface of the straight portion 5 is solder-philic, and also because the solder-repellent nozzle exit surface 4 extends from the opening 3 at a large angle, 180° in this example.

As the peripheral edge of the liquid surface is thus held at the opening 3, the solder drops 11 can be ejected in a steady manner without suffering from variations in the diameter, direction, and speed.

However, the opening 3 corresponds to the boundary between the solder-philic surface of the straight portion 5 and the solder-repellent nozzle exit surface 4. Accordingly, also when the liquid surface is drawn back into the straight portion 5 in reaction to the ejecting, the peripheral edge of the liquid surface is likely to be held at the opening 3, possibly causing inclusion of voids.

Such a problem is due to the fact that the peripheral edge of the liquid surface is held at the opening 3 not only before ejected but also after ejected, and the fact that a part of the straight portion 5 which contacts to the molten solder chamber 1 at the opposite side for the opening 3 (i.e. in the direction away from the ejecting end), has the solder-philic surface.

Figure 2:
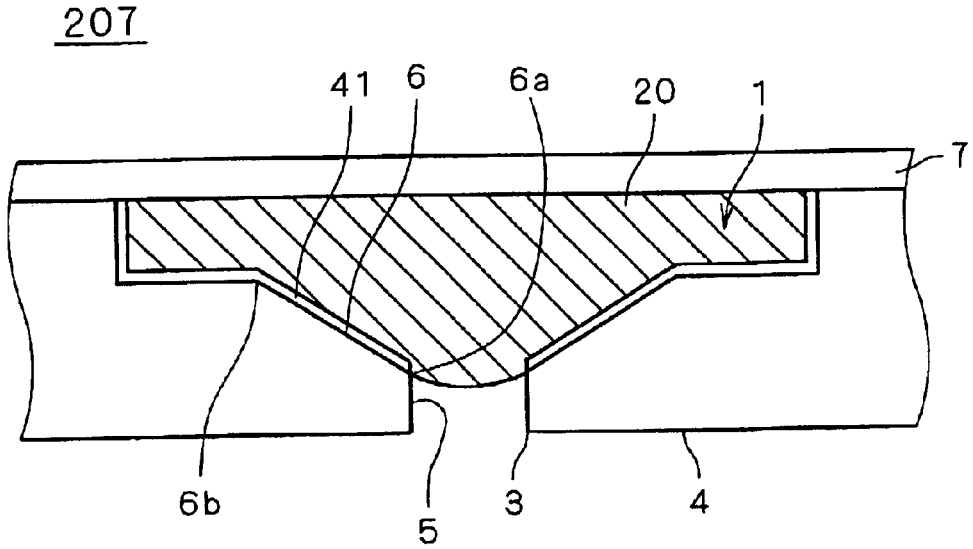
Figure 3:
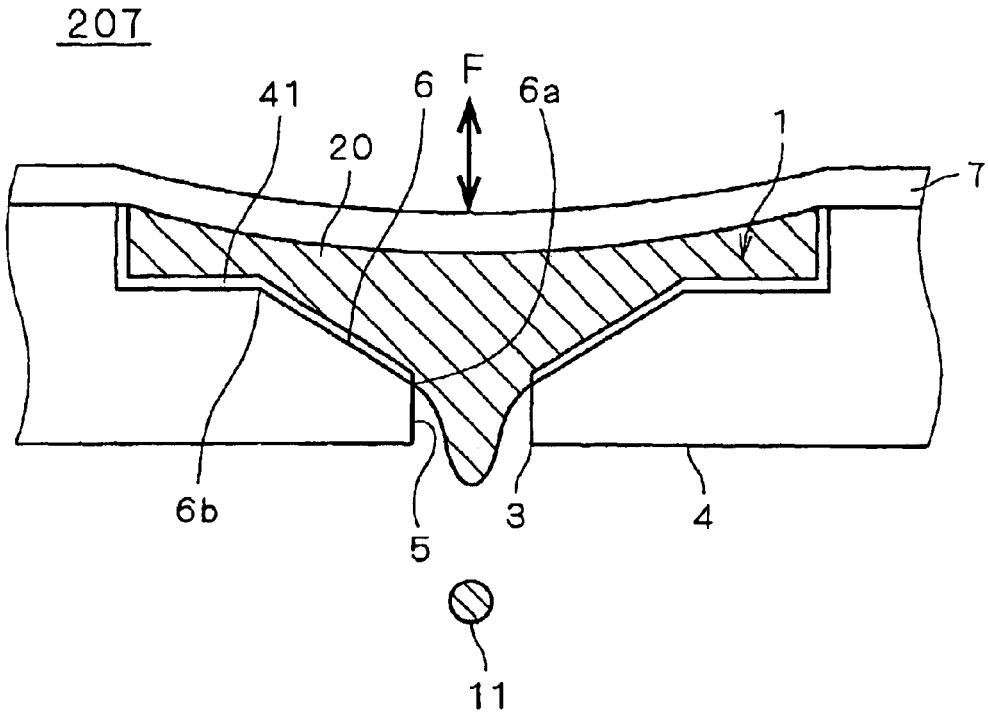
Figure 4:
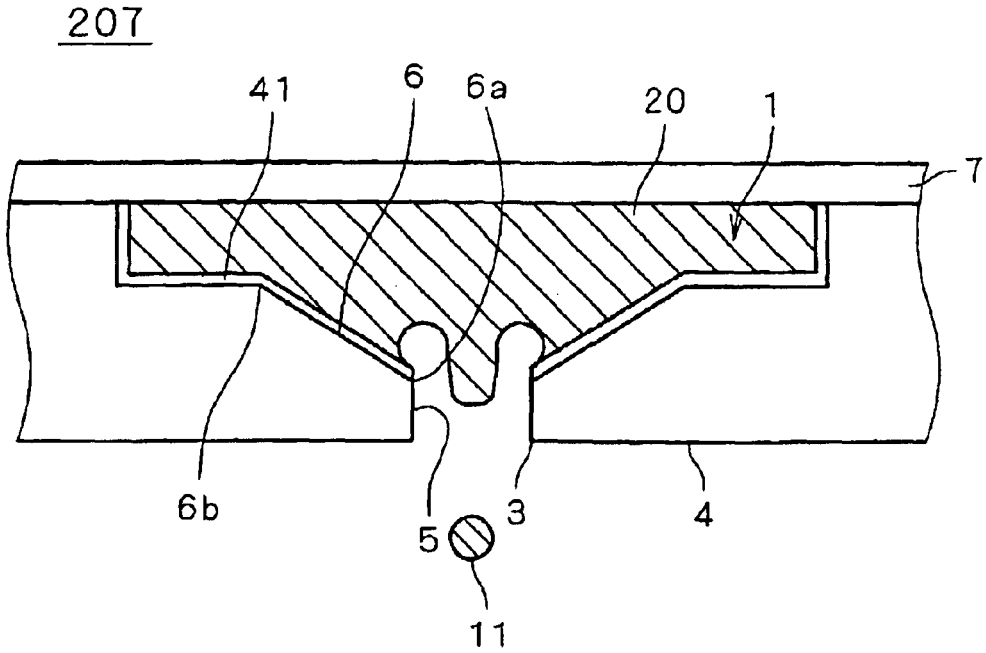
Figure 5:
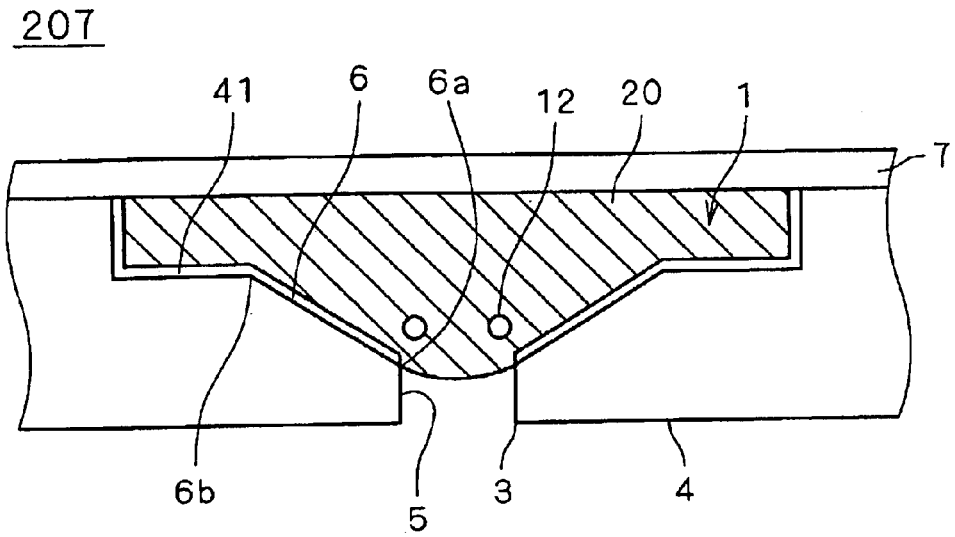
Figure 6:
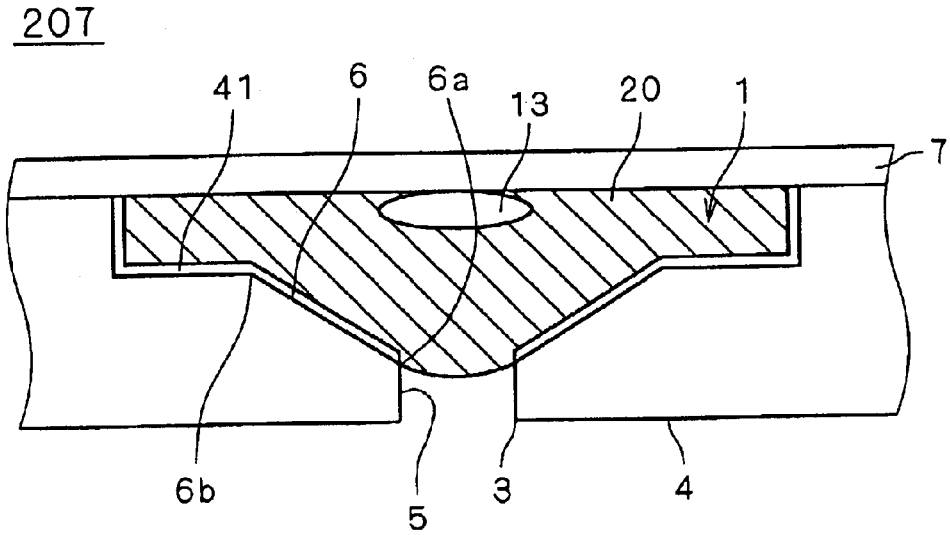

However, such inclusion of voids cannot be avoided even when the straight portion 5 is not covered with the plating layer 41 and is therefore solder-repellent. FIGS. 2 to 6 are cross-sectional views showing the structure of a nozzle 207 based on the introductory idea of the invention, where FIG. 2 shows the condition before ejecting, FIG. 3 shows the condition during ejecting, and FIGS. 4 to 6 show the conditions after ejecting.

Figure 24:
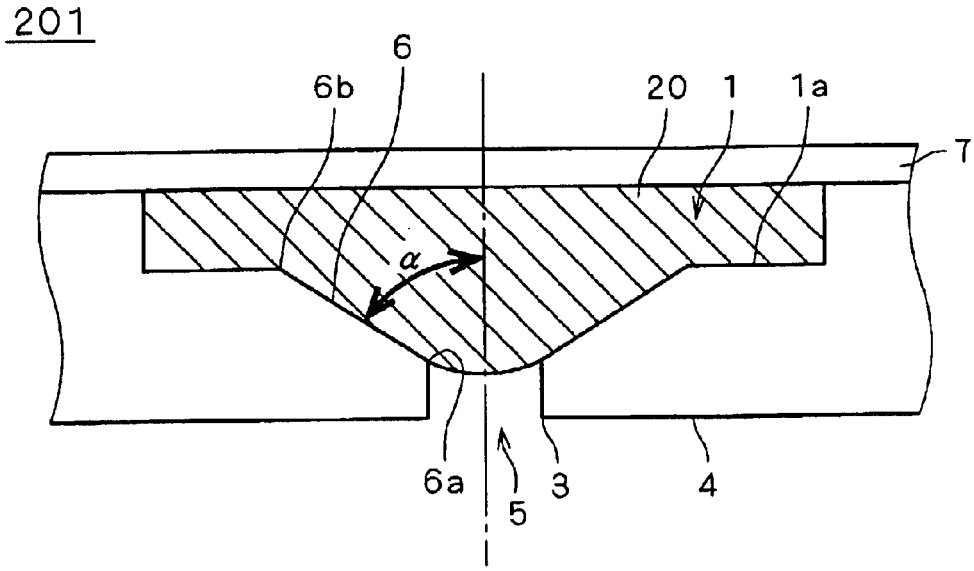
FIG. 24 (PRIOR ART)
Figure 25:
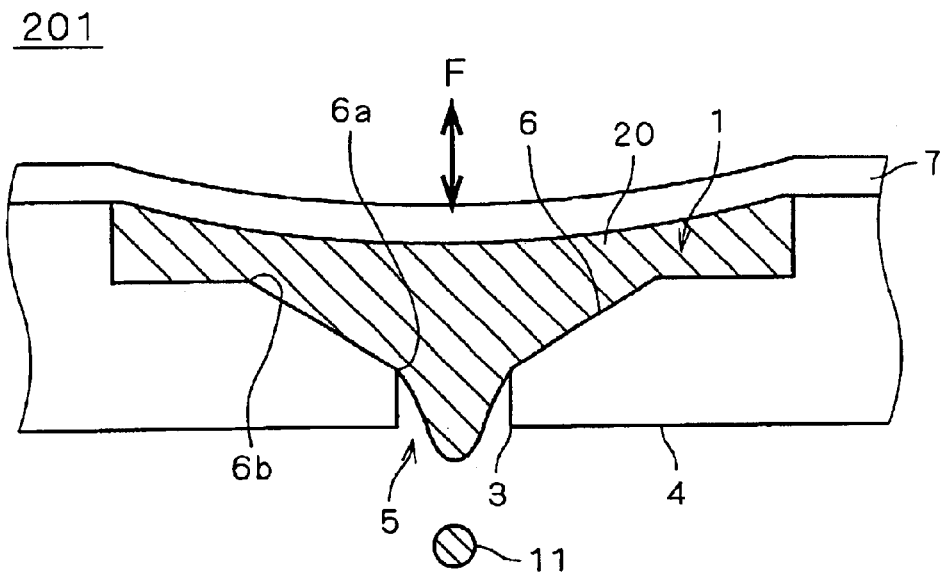
Figure 26:
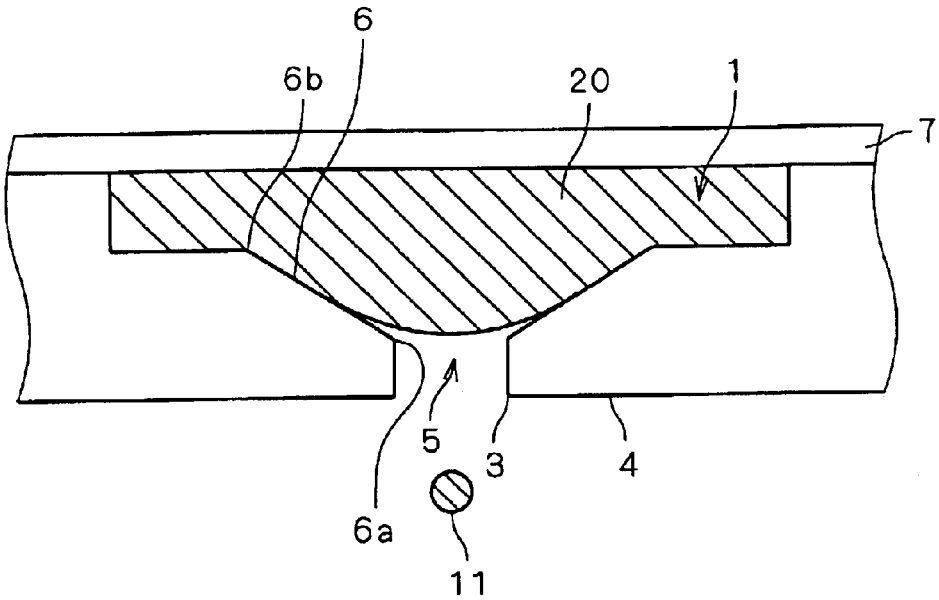

In the nozzle 207, the solder-philic plating layer 41 is formed on the inner surfaces of the tapered portion 6 and the molten solder chamber 1 of the nozzle 201 described referring to FIGS. 24 to 26. Note that, unlike the nozzle 202 of FIG. 1, the nozzle 207 is not provided with the plating layer 41 in the straight portion 5. Accordingly, as shown in FIG. 2, as in the nozzle 201 shown in FIG. 24, the peripheral edge of the liquid surface, before ejected, is held at the edge 6*a* between the tapered portion 6 and the straight portion 5. While the solder drop 11 is being ejected, the peripheral edge of the liquid surface is still held at the edge 6*a*, as in the nozzle 201 shown in FIG. 25.

Then, when the liquid surface is drawn back into the tapered portion 6 in reaction to the ejecting, the solder-philic tapered portion 6 pulls the peripheral edge of the liquid surface in the direction from the edge 6*b* toward the edge 6*a*. As a result, the peripheral edge of the liquid surface is held at the edge 6*a* and the liquid surface waves as shown in FIG. 4.

After that, as shown in FIG. 5, the voids 12 are included in the molten solder 20 in the vicinity of the tapered portion 6. As this phenomenon repeatedly occurs each time the solder drop 11 is ejected, many voids 12 are included and they join together to form a large void 13 in the molten solder chamber 1 as shown in FIG. 6. As the solder is ejected, the large void 13 is compressed or separated into small voids 12, hindering steady ejecting of the solder drops 11.

That is to say, this is because, in the nozzle 207, the edge 6*a* of the tapered portion 6 functions like the opening 3 of the nozzle 202 and the peripheral edge of the liquid surface is held at the edge 6*a* not only before ejected but also after ejected, with the surface of the tapered portion 6, which extends from the edge 6*a* to the molten solder chamber 1 (i.e. in the direction away from the ejecting end), being solder-philic.

Accordingly, as the basic idea of the invention, the inner surface of the nozzle is made solder-repellent in the part nearer to the ejecting end and solder-philic in the part away from it. Then, before ejected, the peripheral edge of the liquid surface is held at a position further forward in the ejecting direction than the boundary between the solder-repellent surface and the solder-philic surface. It is then possible to control the pressure so that the peripheral edge of the liquid surface will not be held at the above-mentioned boundary when the molten solder is ejected and when, afterward, in reaction, it moves opposite to the ejecting direction.

Figure 7:
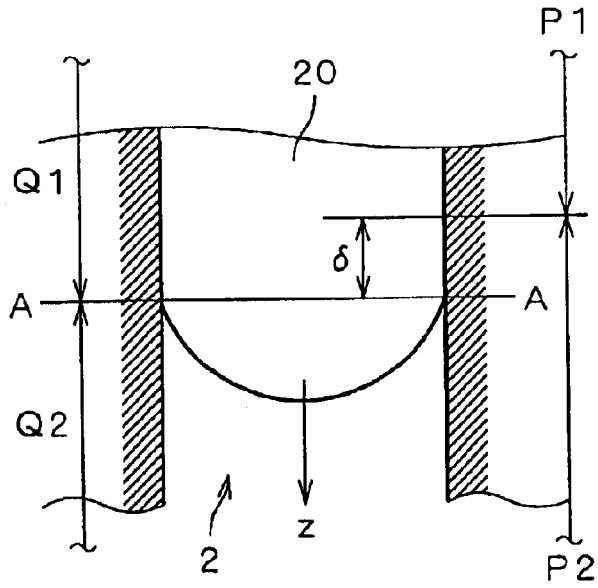
FIGS. 7, 8, 9, 10, and 11 are cross-sectional views showing the present invention.

FIG. 7 is a cross-sectional view showing the basic idea of the invention. The nozzle 2 ejects the molten metal 20 in the ejecting direction Z. The nozzle 2 has a solder-philic surface in the region P1 and a solder-repellent surface in the region P2. The region P2 is located forward of the region P1 in the ejecting direction Z.

Before ejecting, the nozzle 2, using a technique described later, holds the peripheral edge of the liquid surface at the position A that is further forward in the ejecting direction Z by a distance δ (>0) than the boundary between the solder-philic surface and the solder-repellent surface. In other words, with respect to the position A, when the forward side of the ejecting direction Z is taken as a region Q2 and the side opposite to the region Q2 is taken as a region Q1, then the nozzle 2, before ejecting, holds the peripheral edge of the liquid surface at the position A on the boundary between the regions Q1 and Q2.

Figure 27:
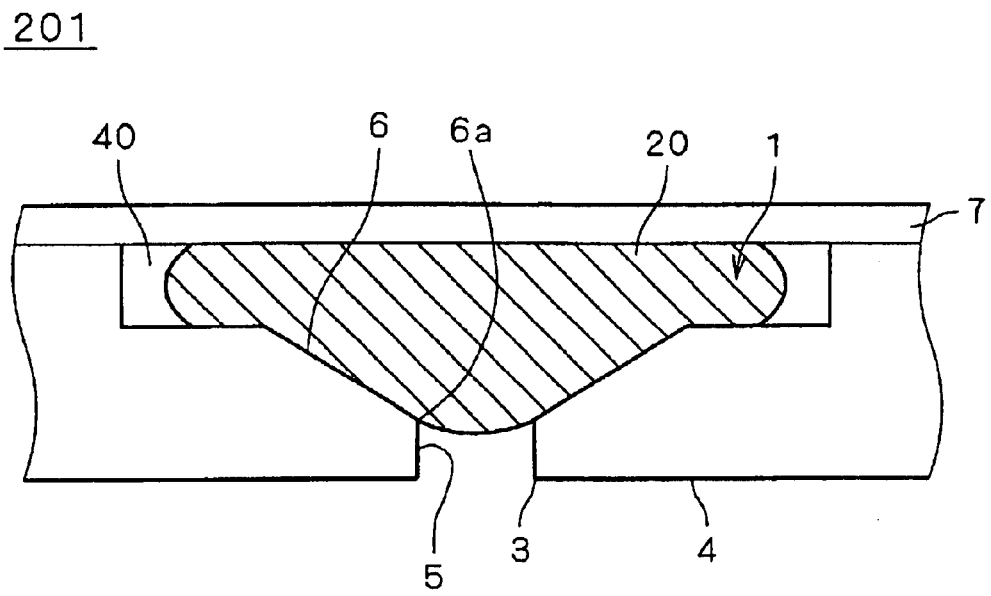

As the peripheral edge of the liquid surface is thus held before ejected, the solder drops can be ejected in a steady manner with a steady diameter, in a steady direction, and at a steady speed. Also, the molten solder 20, to be ejected from the nozzle 2, can be stored in the region P1 with the metal-philic surface surrounding it. This prevents the inclusion of voids, as shown in FIG. 27, while the molten solder 20 is stored.

The pressure applied to the molten solder 20 is controlled so that the peripheral edge of the liquid surface will not move more than the distance δ from the position A when it moves opposite to the ejecting direction Z in ejecting the molten solder 20 or in reaction to the ejecting. Even when the peripheral edge of the liquid surface moves opposite to the ejecting direction Z within the distance δ from the position A, the peripheral edge of the liquid surface is still in the region P2 and in contact with the solder-repellent surface. As mentioned in the description of the introductory idea of the invention, after the solder drop 11 has been ejected, if the peripheral edge of the liquid surface is in contact with a solder-philic surface on the side opposite to the ejecting end, then voids may be included; however, the inclusion of voids can be prevented by controlling the position of the peripheral edge of the liquid surface as shown above.

Next, conditions for setting the regions Q1 and Q2 are provided as shown below so that peripheral edge of the liquid surface can be held at the boundary between the two regions.

B. Holding of Peripheral Edge of Liquid Surface of Molten Solder Before Ejected

Figure 8:
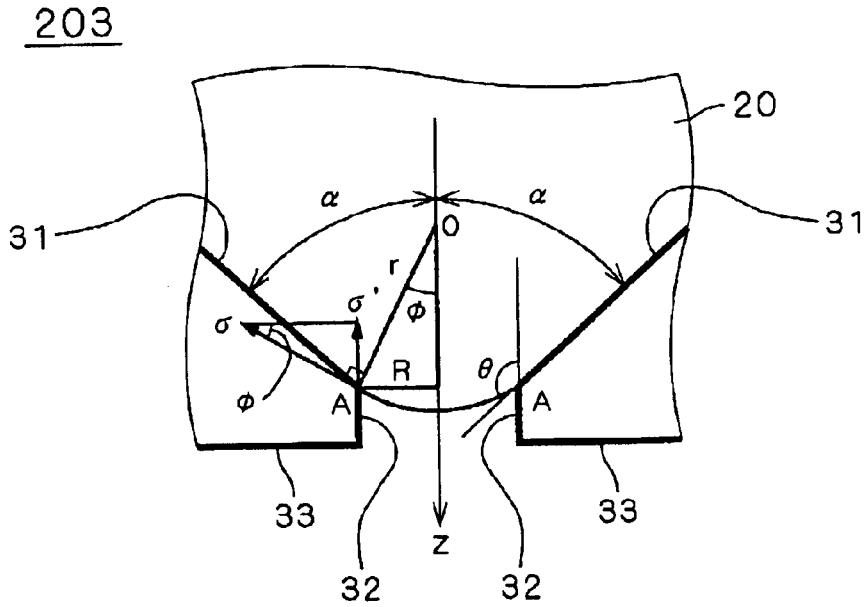

Before describing the preferred embodiments in detail, conditions for holding the peripheral edge of the liquid surface will be described as conditions further set in the basic idea of the invention. The position at which the surface periphery is held is defined by the inner side having a solder-repellent surface. FIG. 8 is a cross-sectional view taken along a section parallel to the ejecting direction Z. A nozzle 203 has a first inner side surface 31, a second inner side surface 32, and a bottom surface 33. For example, the first inner side surface 31, the second inner side surface 32, and the bottom surface 33 are arranged symmetrically about an axis extending in the ejecting direction Z, and specifically, the side of a frustum of a circular cone, the side of a circular cylinder, and a flat plane with a circular opening can be adopted respectively for them.

In this section, the first inner side surface 31 is tapered off at an angle α with respect to the ejecting direction Z. The second inner side surface 32 is parallel to the ejecting direction Z and the bottom surface 33 is perpendicular to the ejecting direction Z. Thus they respectively correspond to the tapered portion 6, the straight portion 5 and the nozzle exit surface 4 of the nozzle 201.

The molten solder 20 can move along the ejecting direction Z when the angle α satisfies Expression (1) which contains a contact angle $\theta_{31}$ (>90°) that the molten solder 20 forms with respect to the first inner side surface 31.

$$\alpha \geqq \theta_{31} - 90^\circ \tag{1}$$

On the other hand, Expression (2) holds about the second inner side surface 32, with the contact angle $\theta_{32}$ (>90°) that the molten solder 20 forms with respect to the second inner side surface 32.

$$0 < \theta_{32} - 90^\circ \tag{2}$$

The angle between the second inner surface 32 and the ejecting direction Z is set so that when the molten solder 20 moves along the ejecting direction Z, it is in contact with the second inner side surface 32 with poor wettability. Then, when no external pressure is applied to the molten solder 20, the peripheral edge of the liquid surface before ejected can be held at the boundary between the first inner side surface 31 and the second inner side surface 32.

Then, unless a large pressure, specifically a pressure exceeding a threshold pressure P1 described later, occurs at the boundary between the first inner side surface 31 and the second inner side surface 32, the molten solder 20 can be held at this boundary as shown in FIG. 8. When the balance with the pressure P occurring at that boundary and the liquid surface tension σ is considered, Expression (3) holds. Note that it is assumed that this boundary forms a circle with a radius R and the liquid surface forms part of a spherical surface with a radius r, and the angle φ between the ejecting direction Z and the straight line from the center O of this spherical surface to that boundary was introduced.

$$P = \frac{2\pi R\sigma\sin\phi}{\pi R^2} = \frac{2\sigma\sin\phi}{r\sin\phi} = 2\sigma/r \tag{3}$$

FIG. 8 also shows the angle θ between the liquid surface and the second inner surface 32. The angle θ increases as the pressure P increases. When the angle θ is less than the contact angle $\theta_{32}$, then the peripheral edge of the liquid surface is held at this boundary. However, when the pressure P larger than a value that causes the angle θ to be equal to the contact angle $\theta_{32}$ occurs at the boundary (this pressure P is the threshold pressure P1 mentioned before), the peripheral edge of the liquid surface is then located within the second inner surface 32. At this time, the radius r is larger than the radius R of the circle formed by this boundary.

Figure 9:
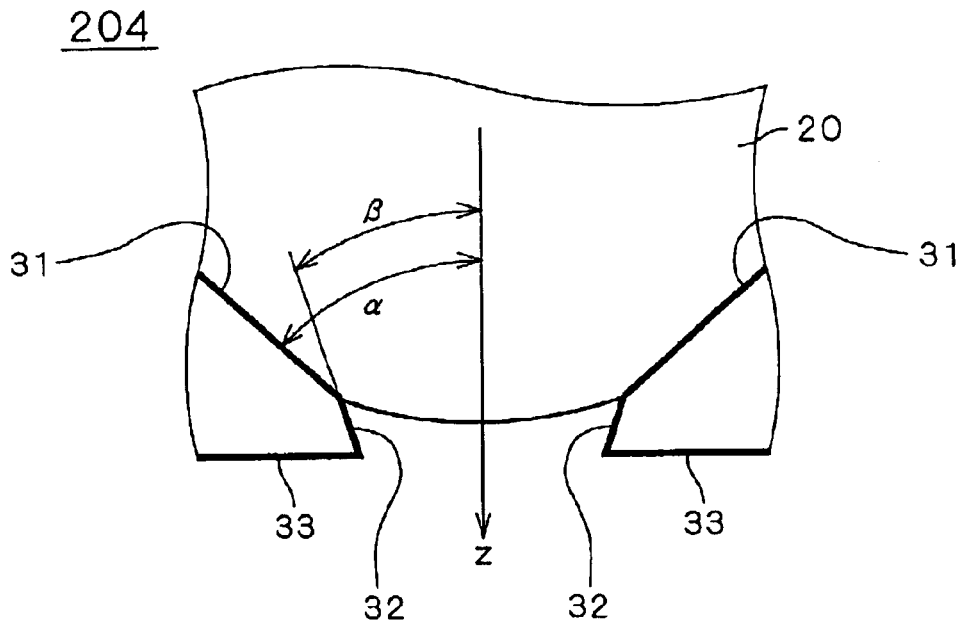

On the basis of Expression (2), the second inner surface 32 may be parallel to the ejecting direction Z as shown in FIG. 8, or it may be tapered off along the ejecting direction Z. FIG. 9 is a cross-sectional view taken along a section parallel to the ejecting direction Z. A nozzle 204 has a first inner side surface 31, a second inner side surface 32, and a bottom surface 33. The second inner side surface 32 is tapered off at an angle β with respect to the ejecting direction Z. Before ejected, the peripheral edge of the liquid surface can be held at the boundary between the first inner side surface 31 and the second inner side surface 32 when Expression (4) is satisfied. In order to remove the case shown in FIG. 8, where the second inner side surface 32 is not tapered, β=0 is removed in Expression (4).

$$0 < \beta < \theta_{32} - 90^\circ \tag{4}$$

Figure 10:
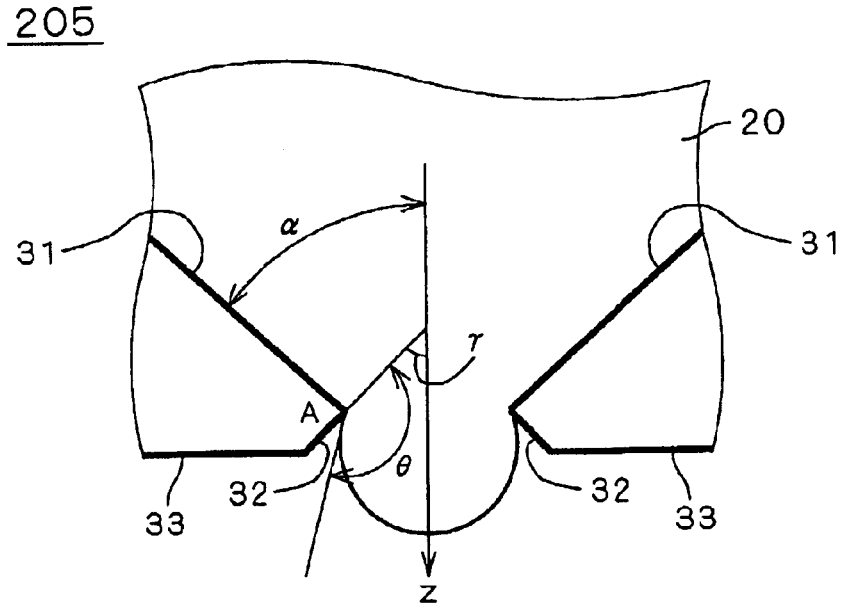

On the other hand, the second inner side surface 32 may be spread out along the ejecting direction Z. FIG. 10 is a cross-sectional view taken along a section parallel to the ejecting direction Z. A nozzle 205 has a first inner side surface 31, a second inner side surface 32, and a bottom surface 33. The second inner side surface 32 is spread at an angle γ with respect to the ejecting direction Z. The peripheral edge of the liquid surface before ejected can be held at the boundary between the first inner side surface 31 and the second inner side surface 32 when Expression (4) is satisfied, and so γ can be set within the range of 0 to 180°. Note that when γ=0, it corresponds to the structure shown in FIG. 8, where the second inner side surface 32 is not tapered.

In the case shown in FIG. 8, the radius r of the spherical surface, a part of which is formed by the liquid surface, is larger than the radius R of the circle formed by the boundary between the first inner side surface 31 and the second inner side surface 32. However, when Expression (5) is satisfied, the angle θ between the tangent of the liquid surface at the position A and the second inner surface 32 can be increased up to the contact angle $\theta_{32}$. Considering this fact, and the fact that, when the angle θ is equal to (180°−γ), then the radius r equals the radius R, and the fact that from Expression (5) the contact angle $\theta_{32}$ is not less than (180°−γ), it is understood that there is an angle θ with which the pressure P at this boundary reaches up to the maximum pressure $P_{max}$ shown by Expression (6). In other words, the peripheral edge of the liquid surface can be held at this boundary even when a large pressure P occurs at the boundary. However, when the angle θ is equal to or larger than the contact angle $\theta_{32}$, the liquid surface cannot be held at the position A and it overflows from the position A onto the second inner side surface 32.

$$\gamma \leqq 180° - \theta_{32} \quad (5)$$

$$P_{max} = 2\sigma/R \quad (6)$$

Figure 11:
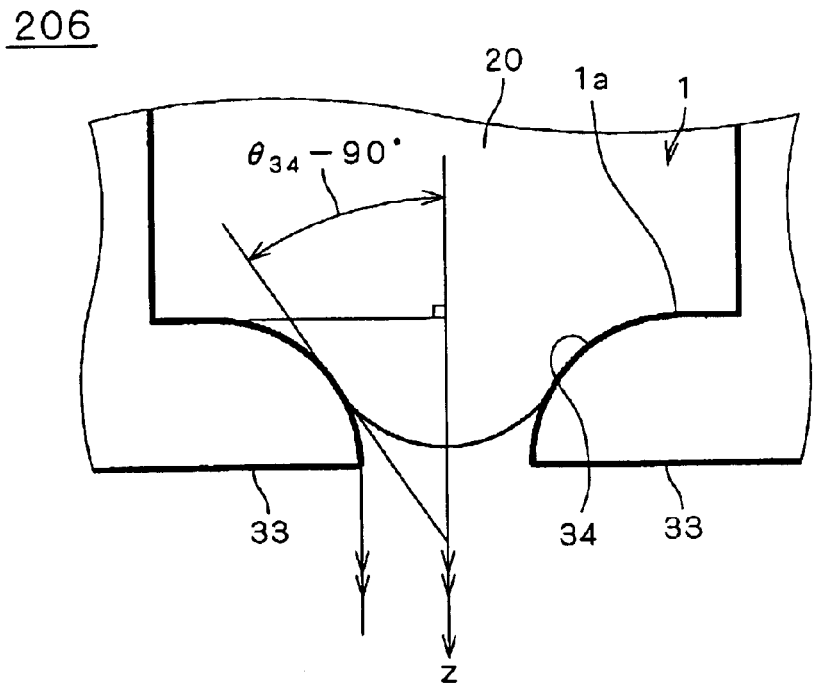

The first inner side surface 31 and the second inner side surface 32 may form a curved surface together. FIG. 11 is a cross-sectional view taken along a section parallel to the ejecting direction Z. The nozzle 206 has the molten solder chamber 1, an inner side surface 34, and the bottom surface 33. The inner side surface 34 connects with the bottom surface 1*a* of the molten solder chamber 1 and the bottom surface 33. The angle between said ejecting direction Z and the tangent of the curve formed by the inner side surface 34 in this section continuously varies from 90° to 0° along the ejecting direction Z. FIG. 11 shows an example in which the bottom surfaces 1*a* and 33 are perpendicular to the ejecting direction Z, and therefore the bottom surface 1*a* and the inner side surface 34 meet at an angle of 0° in this section and the bottom surface 33 and the inner side surface 34 meet at 90° in this section.

As the tangent of the inner side surface 34 in the section is thus set, when the contact angle $\theta_{34}$ (>90°) which the molten solder 20 forms with respect to the inner side surface 34 is introduced, then a tangent which forms an angle ($\theta_{34}$−90°) with the ejecting direction Z exists on the inner side surface 34. Accordingly, as long as the inner side surface 34 is solder-repellent, the peripheral edge of the liquid surface before ejected can be held independently of the contact angle $\theta_{34}$.

C. Preferred Embodiments

First Preferred Embodiment

Figure 12:
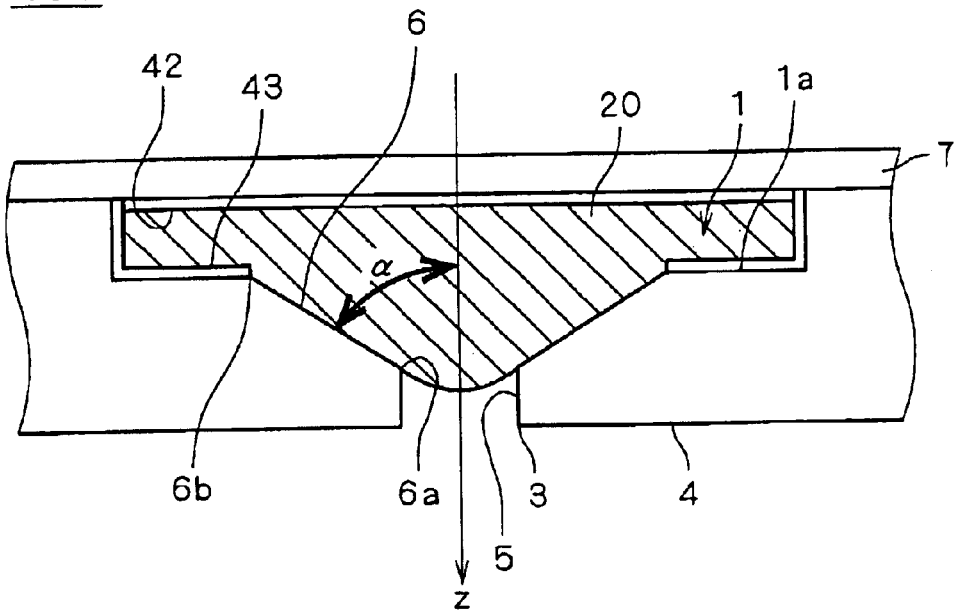
FIGS. 12, 13, 14, and 15 are cross-sectional views showing structures of nozzles according to a first preferred embodiment of the invention.
Figure 13:
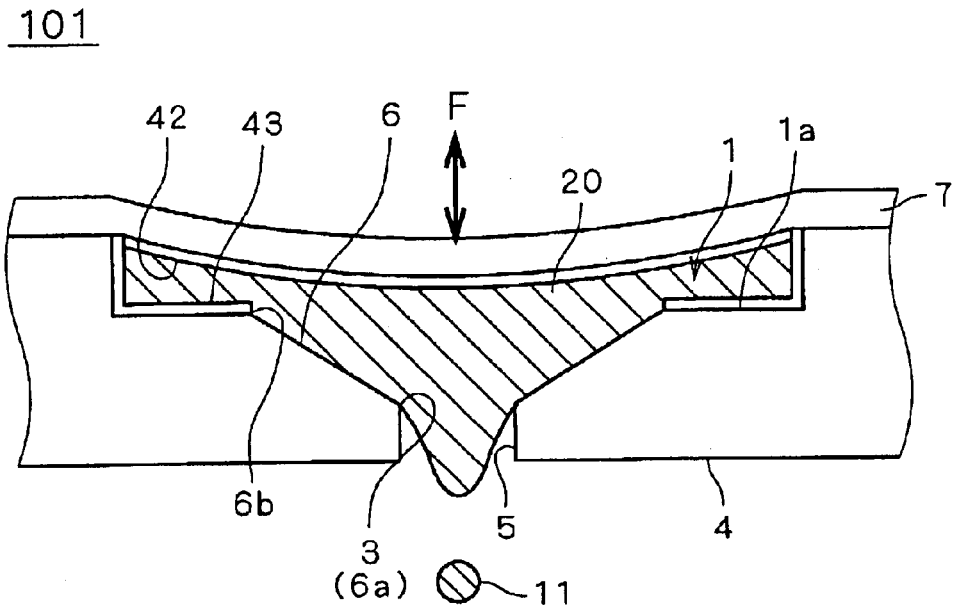
Figure 14:
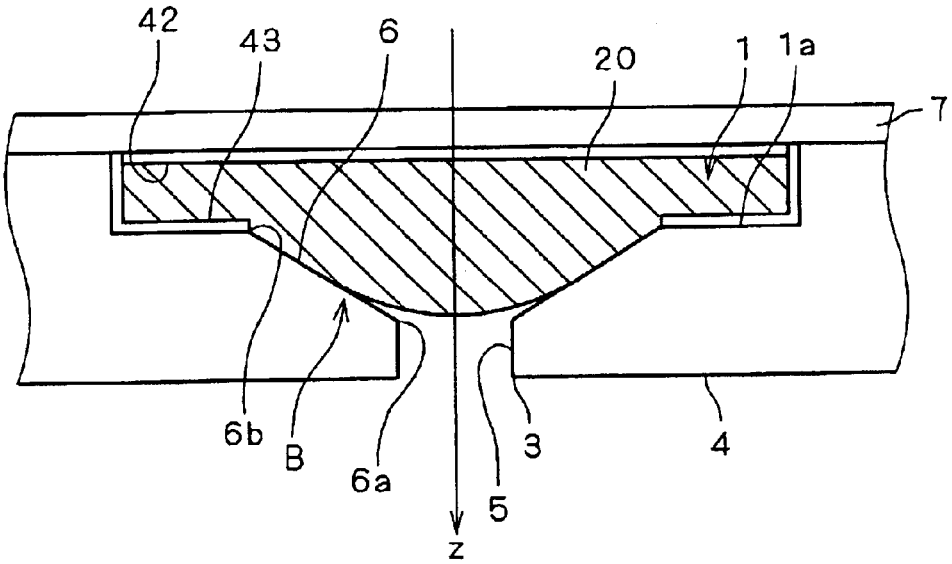

FIGS. 12 to 14 are cross-sectional views of a nozzle 101 according to a first preferred embodiment of the present invention, which shows the structure appearing in a section parallel to the ejecting direction Z. The nozzle 101 has a molten solder chamber 1, a tapered portion 6 communicating therewith, and a straight portion 5 communicating with the tapered portion 6. The tapered portion 6 has edges 6*a* and 6*b* which adjoin the straight portion 5 and the molten solder chamber 1, respectively. The straight portion 5 has an opening 3 in the nozzle exit surface 4. The nozzle 101 may be made by adopting a solder-repellent material, such as ceramics (e.g. zirconia), stainless steel, quartz glass, or ruby. The molten solder chamber 1, the straight portion 5, and the tapered portion 6 can be formed by machining. Ceramics have good solder-repellent property but are difficult to process, while stainless steel is superior in strength and processibility but inferior to ceramics in solder-repellent property.

The molten solder chamber 1 is covered with a diaphragm 7, which faces to the bottom surface 1*a* of the chamber 1. The molten solder 20 is stored with the molten solder chamber 1 and the diaphragm 7 enclosing it. A solder-philic layer 42 is formed on the surface of the diaphragm 7 that lies opposite the bottom surface 1*a*. A solder-philic layer 43 is formed on the bottom surface 1*a* of the molten solder chamber 1 and on its side surface extending from the bottom surface 1*a* to the diaphragm 7. Accordingly the molten solder 20 is stored in the molten solder chamber 1 with good wettability and voids 40 (see FIG. 27) will not remain in the molten solder chamber 1 when the molten solder chamber 1 is first charged with the molten solder 20.

The solder-philic layers 42 and 43 may be formed by plating, coating, sputtering, or vapor deposition. Plating is the easiest method among them. Plating materials having good wettability with respect to the molten solder 20 include gold, copper, tin, nickel, platinum, and palladium. While gold, copper, and tin have good wettability with respect to the molten solder 20, they are susceptible to erosion by the molten solder 20. When erosion occurs, the solder-philic layers 42 and 43 will be removed and then it is difficult to ensure steady solder-phile for a long time. Gold and palladium, noble metals, are expensive.

As compared with these materials, nickel is insusceptible to erosion by the molten solder 20, lower in price, and has good wettability with respect to the molten solder 20. Furthermore, when stainless steel is adopted as the material of the nozzle 101, nickel plating can be directly applied without the need for underlayer.

Other desirable plating layer materials for the solder-philic layers 42 and 43 include: Ni—P which contains nickel (Ni) and a small amount of phosphorus (P); Ni—B which contains boron (B); Ni—P—W which contains phosphorus and tungsten (W); and Ni—B—W which contains boron and tungsten. When such materials are adopted, the plating layers provide as good wettability as a plating layer of nickel with respect to the molten solder 20 and still less susceptibility to erosion by the molten solder 20.

When the nozzle 101 is made of ceramic and the solder-philic layers 42 and 43 are formed by plating using nickel or a material mainly containing nickel as shown above, it is desired, before plating, to sputter chromium (Cr) or titanium (Ti) and then sputter copper (Cu), so as to enhance the adhesion of the solder-philic layers 42 and 43.

The solder-philic layer 42 does not have to be formed when the diaphragm 7 is made of a solder-philic member.

The tapered portion 6 is tapered off at an angle α with respect to the ejecting direction Z and the straight portion 5 is parallel to the ejecting direction Z. For example, the tapered portion 6 forms the side of a frustum of a circular cone having its axis parallel to the ejecting direction Z and the straight portion 5 forms the side of a circular cylinder having the same axis. However, note that the straight portion 5 and the tapered portion 6 do not necessarily have to be axisymmetric. They are just required to satisfy conditions necessary for the angles α and γ as will be described later in this and following preferred embodiments.

In the first preferred embodiment, the tapered portion 6 and the straight portion 5 are made of the same material. When the contact angle that the molten solder 20 forms with respect to this material is taken as θs, then the angle α shall satisfy Expression (7).

$$\alpha \geqq \theta s - 90^\circ \quad (7)$$

On the other hand, since a solder-repellent material is adopted for the tapered portion 6 and the straight portion 5, the angle θs satisfies Expression (8).

$$0 < \theta s - 90^\circ \quad (8)$$

Thus, as described in Section B using Expressions (1) and (2), the peripheral edge of the liquid surface of the molten solder 20 is held at the edge 6*a* as shown in FIG. 12, unless a pressure exceeding the threshold pressure P1 occurs at the boundary between the tapered portion 6 and the straight portion 5, i.e. at the edge 6*a*.

FIG. 13 shows the condition in which the molten solder 20 is being ejected. A force F is applied to the diaphragm 7 from a pressure source not shown, e.g. a piezoelectric device. The force F presses down the molten solder 20 into the opening 3 and then draws it back into the molten solder chamber 1. As the force F is thus applied in reciprocating directions, a portion of the molten solder 20 is ejected out of the nozzle 101 as a solder drop 11, through the straight portion 5 and from the opening 3. The position of the peripheral edge of the liquid surface can thus be held before the molten solder 20 is ejected, and therefore the pressure required for ejecting can rise sharply, thus avoiding timing delay in ejecting the solder drop 11 and variations in the diameter, direction, and speed of the ejected solder drops 11.

FIG. 14 shows the condition after the solder drop 11 has been ejected. The force F is not applied to the diaphragm 7 and the diaphragm 7 has returned to its original position. While the angle α formed by the tapered portion 6 satisfies Expression (7), the liquid surface is pulled into the tapered portion 6 in reaction to the ejecting and the peripheral edge of the liquid surface once rises to the position B nearer to the edge 6*b* than the edge 6*a* is. After that, the peripheral edge of the liquid surface returns to the condition shown in FIG. 12 to be held at the edge 6*a* until the force F is next applied to the diaphragm 7 to eject the solder drop 11.

In this preferred embodiment, the edge 6*a* corresponds to the boundary between the regions Q1 and Q2 shown in FIG. 7, the edge 6*b* corresponds to the boundary between the regions P1 and P2 of FIG. 7, and the tapered portion 6 corresponds to the distance 6. Accordingly the liquid surface can be prevented from waving, as shown in FIG. 4, by controlling the force F so that the position B, to which the peripheral edge of the liquid surface is drawn back, stays within the tapered portion 6, and then voids 12 and 13 (see FIGS. 5 and 6) will not be formed and the solder can be steadily ejected thereafter. Needless to say, since the position B is located further forward in the ejecting direction Z than the bottom surface 1*a*, the effect of avoiding voids 12, 13 is not deteriorated even if the solder-philic layers 42 and 43 have been eroded by the molten solder 20.

Considering Expressions (4) and (5), the straight portion 5 may be tapered off at an angle β satisfying Expression (9) with respect to the ejecting direction Z, or it may be spread with respect to the ejecting direction Z, more preferably spread at an angle γ which satisfies Expression (10).

$$0 < \beta < \theta s - 90^\circ \quad (9)$$

$$\gamma \geqq 180^\circ - \theta s \quad (10)$$

FIG. 13 shows an example in which the peripheral edge of the liquid surface is held at the edge 6*a* not only before ejected but also while being ejected. However, while it is preferred that the liquid surface is held at the edge 6*a* before the solder drop 11 is ejected, the liquid surface does not necessarily have to be held while being ejected. Or, while the peripheral edge of the liquid surface is held at the edge 6*a* before ejected, it may be held, while being ejected, at a position still closer to the forward end of the ejecting direction Z, e.g. at the opening 3. That is to say, the pressure P occurring at the edge 6*a* may exceed the threshold pressure P1.

Figure 15:
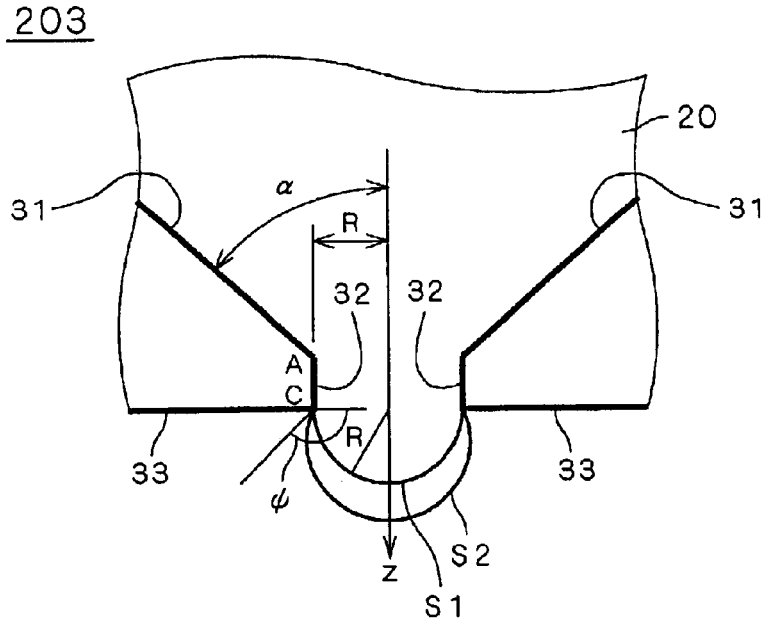

FIG. 15 is a cross-sectional view showing the peripheral edge of the liquid surface held at the position C on the boundary between the second inner side surface 32 and the bottom surface 33 in the nozzle 203. The position C corresponds to the opening 3 of the nozzle 101. The bottom surface 33 extends at 90° with respect to the ejecting direction Z. By introducing the contact angle $\theta_{33}$ formed by the molten solder with respect to the bottom surface 33, Expression (11) holds like Expression (5). This is because the contact angle $\theta_{33}$ is larger than 90°, since the bottom surface 33 is solder-repellent.

$$90^\circ > 180^\circ - \theta_{33} \quad (11)$$

Accordingly, as in the case shown in FIG. 10, the pressure P that is applied when the peripheral edge of the liquid surface is held at the position C can reach up to the maximum pressure $P_{max}$. The liquid surface P in this case forms a semi-spherical surface S1 with the radius R. As the pressure P further increases, this liquid surface forms a part S2 of a spherical surface with a radius larger than R. Then, when the angle ψ between the tangent of the liquid surface at the position C and the bottom surface 33 becomes equal to the contact angle $\theta_{33}$ or larger, the liquid surface can no longer be held and the molten solder 20 overflows from the position C onto the bottom surface 33.

The position C shown in FIG. 15 corresponds to the opening 3 of the nozzle 101. Thus, even when the solder drop 11 is ejected with the liquid surface held at the opening 3 of the nozzle 101, no problem arises as long as the peripheral edge of the liquid surface is not drawn back to reach the edge 6*b* in reaction to the ejecting.

Second Preferred Embodiment

Figure 16:
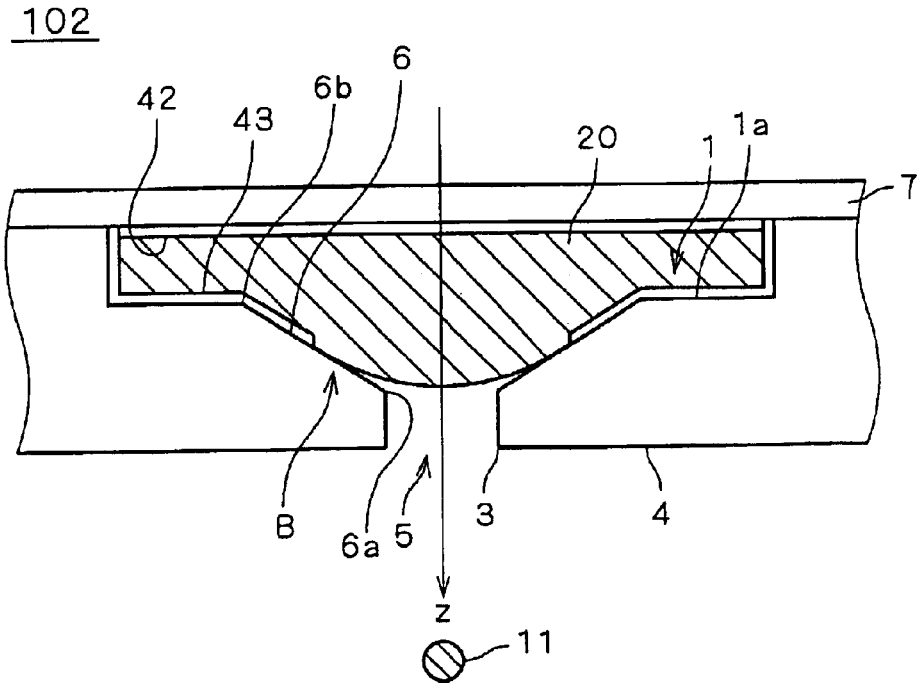
FIG. 16 is a cross-sectional view showing the structure of a nozzle according to a second preferred embodiment of the invention.

FIG. 16 is a cross-sectional view of a nozzle 102 according to a second preferred embodiment of the invention, which shows the structure appearing in a section parallel to the ejecting direction Z. The nozzle 102 is a modification of the nozzle 101, where the solder-philic layer 43 is extended not only on the bottom surface 1*a* of the molten solder chamber 1 but also onto the tapered portion 6 past the edge 6*b*. The tapered portion 6 satisfies Expression (7) as in the nozzle 101. The straight portion 5 may be tapered off at an angle β satisfying Expression (9) with respect to the ejecting direction Z, or it may be spread out with respect to the ejecting direction Z, more preferably spread at an angle γ which satisfies Expression (10).

In this structure, as in the nozzle 101, the effects shown in the first preferred embodiment can be obtained as long as the position B, at which the peripheral edge of the liquid surface is located when drawn back in reaction to the ejecting, is located further forward than the solder-philic layer 43 in the ejecting direction Z.

The solder-philic layer 43 might be eroded by the molten solder 20 since the molten solder 20 intensively flows on the tapered portion 6 when the solder drop 11 is ejected. However, in the tapered portion 6, the molten solder 20 does not flow so intensively in the vicinity of the edge 6*b* as it does in the vicinity of the edge 6*a*. Accordingly, even when, as shown in the nozzle 102, the solder-philic layer 43 on the bottom surface 1*a* of the molten solder chamber 1 extends onto the tapered portion 6 past the edge 6*b*, it will not be easily eroded by the molten solder 20.

Furthermore, the nozzle 102 has a manufacturing advantage. When manufacturing a structure like the nozzle 101 in which the solder-philic layer 43 is formed on the bottom surface 1*a* but not on the tapered portion 6 at all, it is necessary during the process (e.g. plating) for forming the solder-philic layer 43 that a plating-blocking mask precisely cover the tapered portion 6. However, in the nozzle 102, the solder-philic layer 43 is allowed to extend past the edge 6*b* onto the tapered portion 6, so that a mask smaller than the size of the edge 6*b* can be used and it can be positioned easily.

That is to say, since the boundary between the solder-philic layer 43 presenting a solder-philic surface and the solder-repellent surface part of the tapered portion 6 is located within the tapered portion 6, the process of forming the solder-philic layer 43 can be easier than when the tapered portion 6 is made entirely solder-repellent with no solder-philic layer 43 thereon. Also, since the solder-philic surface extends halfway in the tapered portion 6, voids are less likely to remain in the tapered portion 6 when the molten solder 20 is first supplied.

Third Preferred Embodiment

Figure 17:
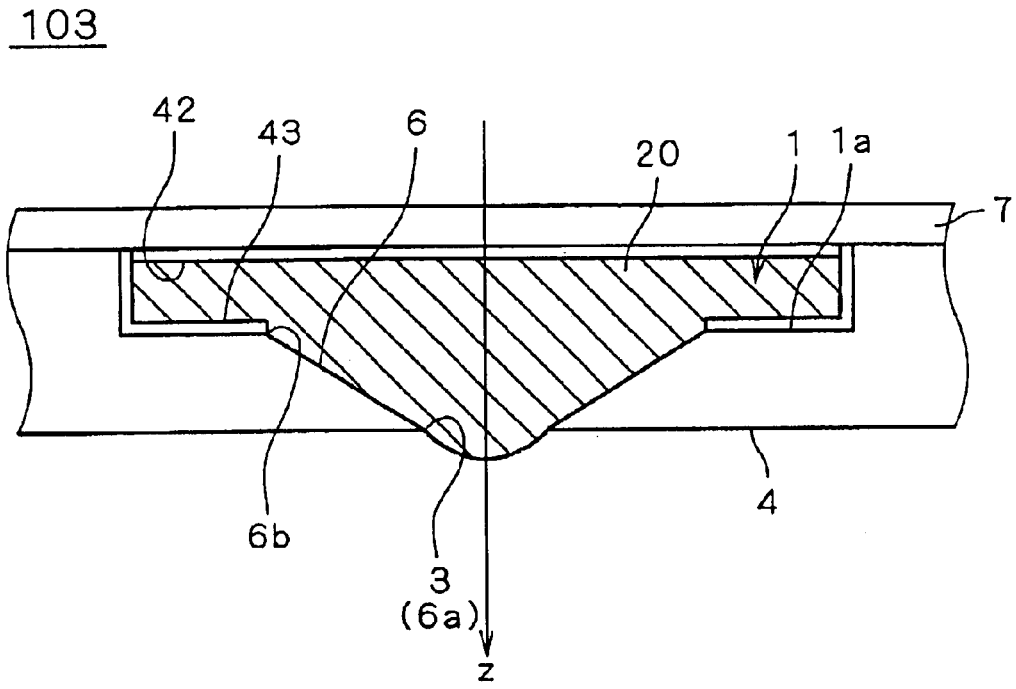
FIGS. 17 and 18 are cross-sectional views showing the structure of a nozzle according to a third preferred embodiment of the invention.
Figure 18:
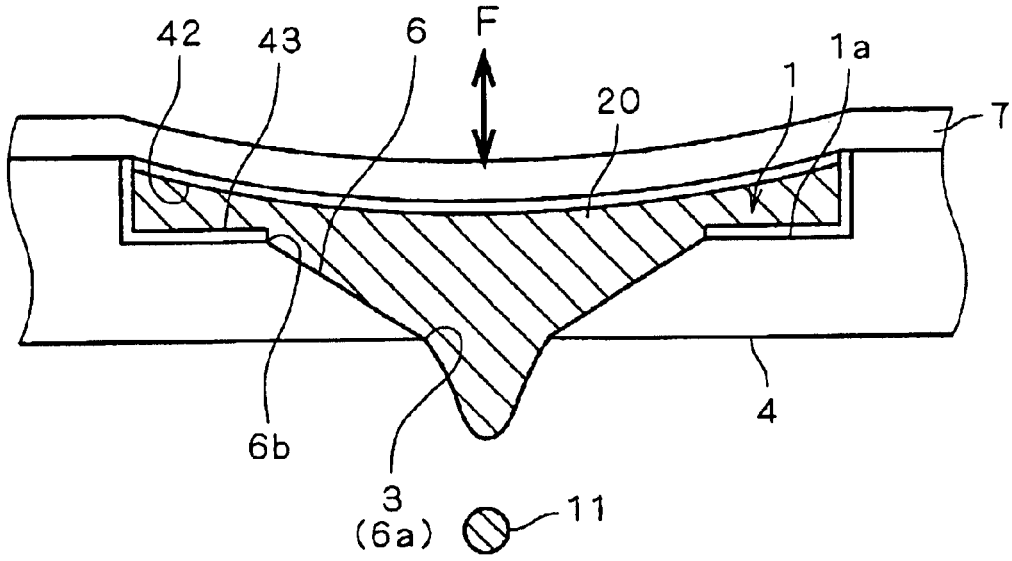

FIGS. 17 and 18 are cross-sectional views of a nozzle 103 according to a third preferred embodiment of the invention, which show the structure appearing in a section parallel to the ejecting direction Z. The nozzle 103 does not have the straight portion 5. Accordingly the edge 6*a* of the tapered portion 6 is regarded as the boundary between the tapered portion 6 and the nozzle exit surface 4, which can also be regarded as the opening 3. Also, considering FIG. 10, this structure corresponds to an example in which the angle $\gamma$ is 90° and the second inner side surface 32 coincides with the bottom surface 33. Also in the nozzle 103, the solder-philic layer 43 may be extended from the bottom surface 1*a* onto the tapered portion 6 past the edge 6*b*, as in the nozzle 102. The tapered portion 6 satisfies Expression (7), as in the nozzle 101.

FIG. 17 shows the condition before the solder drop 11 is ejected, and FIG. 18 shows the condition where the solder drop 11 is being ejected. In either condition, the peripheral edge of the liquid surface is held at the opening 3 (i.e. at the edge 6*a*). Also when the nozzle 103 is used, the force F is controlled so that the peripheral edge of the liquid surface, when drawn back in reaction to the ejecting of the solder drop 11, does not reach the solder-philic layer 43. Thus this structure offers the same effects as the nozzles 101 and 102.

Unlike the nozzles 101 and 102, the nozzle 103 does not have the straight portion 5, and therefore the liquid surface, which protrudes when the solder drop 11 is ejected, does not come into contact with the straight portion 5. Therefore the solder drops 11 will not be ejected in skewed direction and can be ejected in a steady manner.

Obtaining this effect does not necessarily require that the edge 6*a* and the opening 3 coincide with each other. FIGS. 17 and 18 show an example in which $\gamma$ is 90° in FIG. 10; as has been described referring to FIG. 10 and as shown by Expression (5), as long as Expression (5) is satisfied, the angle $\theta$ between the tangent of the liquid surface at the position A and the second inner surface 32 can increase up to the contact angle $\theta_{32}$. Thus, the liquid surface protruding when ejected does not come into contact with the second inner surface 32 as long as the angle $\gamma$ satisfies Expression (5).

Fourth Preferred Embodiment

Figure 19:
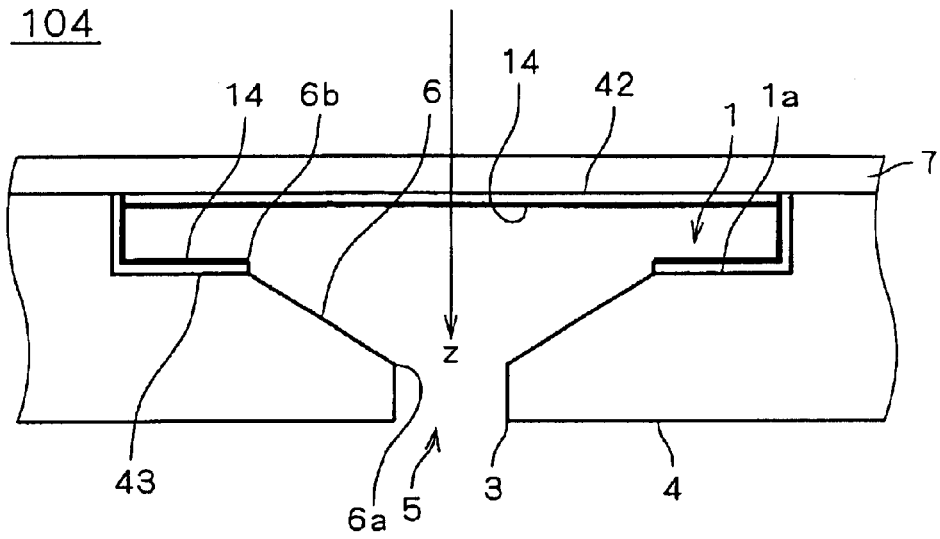
FIG. 19 is a cross-sectional view showing the structure of a nozzle according to a fourth preferred embodiment of the invention.

FIG. 19 is a cross-sectional view of a nozzle 104 according to a fourth preferred embodiment of the invention, which shows the structure appearing in a section parallel to the ejecting direction Z. In FIG. 19, the molten solder chamber 1 has not yet been charged with molten solder. In the nozzle 104, a solder plating layer 14 is formed on the solder-philic layer 43 of the nozzle 101. The tapered portion 6 satisfies Expression (7) as in the nozzle 101. The straight portion 5 may be tapered off at an angle $\beta$ which satisfies Expression (9) with respect to the ejecting direction Z, or it may be spread out with respect to the ejecting direction Z, more preferably spread at an angle $\gamma$ which satisfies Expression (10). The solder plating layer 14 may be provided on the solder-philic layer 43 also in the nozzles 102 and 103.

When molten solder is supplied into the molten solder chamber 1 through a passage not shown, it can be smoothly introduced into the molten solder chamber 1 since the molten solder exhibits very large wettability with respect to the solder plating layer 14. Further, the solder plating layer 14 covering the solder-philic layer 43 prevents oxidation of the solder-philic layer 43. This prevents deterioration of the wettability of the molten solder due to oxide film.

The solder plating layer 14 readily dissolves into the molten solder supplied, leaving no residue. Therefore, after the molten solder has been contained in the molten solder chamber 1, the nozzle 104 exhibits the same structure as the nozzle 101 containing molten solder in the molten solder chamber 1. Thus the nozzle 104 provides the same effects as those of the first preferred embodiment after the molten solder has been contained.

As described above, when the solder plating layer 14 once comes in contact with the molten solder, it dissolves into the molten solder with no residue. Therefore the straight portion 5 and the tapered portion 6, too, may be plated with the solder plating 14.

The effect of preventing oxidation of the solder-philic layer 43 and the effect of allowing the molten solder to be smoothly supplied into the nozzle 102 at the first time can be obtained also by providing a gold plating layer instead of the solder plating layer 14. However, gold (Au) reacts with tin (Sn) in the molten solder to produce Au—Sn alloy. The Au—Sn alloy has stronger viscosity than solder. Therefore, when the gold plating layer is provided, Au—Sn alloy is likely to adhere to the tapered portion 6, the straight portion 5, or the nozzle exit surface 4 around the opening 3, which may adversely affect the ejecting operation. Adopting the solder plating layer 14 thus prevents oxidation of the solder-philic layer 43 and allows the molten solder to be smoothly introduced into the nozzle 102 at the first time without producing unwanted impurities.

Fifth Preferred Embodiment

Figure 20:
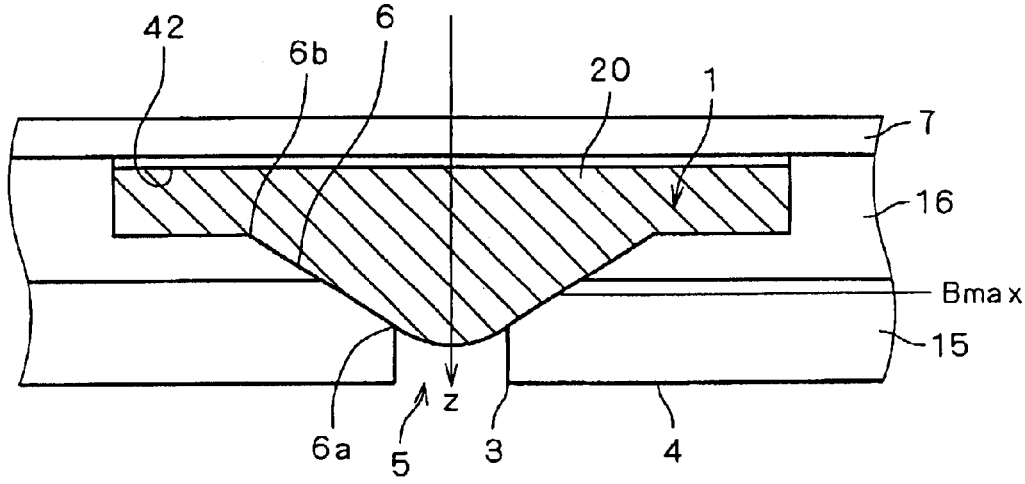
FIG. 20 is a cross-sectional view showing the structure of a nozzle according to a fifth preferred embodiment of the invention.

FIG. 20 is a cross-sectional view of a nozzle 105 according to a fifth preferred embodiment of the invention, which shows the structure appearing in a section parallel to the ejecting direction Z. Like the nozzle 201, the nozzle 105 has the molten solder chamber 1, the tapered portion 6, and the straight portion 5. As in the nozzle 101, the tapered portion 6 satisfies Expression (7). The straight portion 5 may be tapered with respect to the ejecting direction Z at an angle $\beta$ which satisfies Expression (9), or it may be spread out with respect to the ejecting direction, more preferably spread at an angle γ which satisfies Expression (10).

The nozzle 105 is formed of a solder-philic first plate 16 and a second plate 15 bonded together. The second plate 15 is located on the side of the nozzle exit surface 4, while the first plate 16 is located away from the nozzle exit surface 4. The boundary between the first plate 16 and the second plate 15 is located, at least on the surface on which the molten solder 20 contacts, between the bottom surface 1*a* of the molten solder chamber 1 and the position Bmax to which the peripheral edge of the liquid surface is drawn back closest to the molten solder chamber 1 in reaction to the ejecting.

The molten solder chamber 1 is covered by the diaphragm 7 and the solder-philic layer 42 is formed on the side of the diaphragm 7 that lies opposite the bottom surface 1*a*. However, the solder-philic layer 42 does not have to be formed when the diaphragm 7 is formed of a solder-philic member.

The solder-philic surface needed in the nozzle 105 is presented by the first plate 16 without the need to adopt the solder-philic layer 43 adopted in the nozzles 101 to 104. This eliminates the need for the surface treatment for specially forming the solder-philic layer 43, reducing the time and process steps for manufacturing the nozzle 105, and leading to a reduction in cost. Furthermore, it is possible to avoid the problems that the solder-philic layer 43 may be eroded and removed by the molten solder 20, or peel off as the molten solder 20 is cooled and shrinks. Therefore the wettability of the molten solder 20 to the metal-philic surface and the metal-repellent surface can be kept unchanged and the long-lasting steady wettability provides the advantage of high reliability.

Sixth Preferred Embodiment

Figure 21:
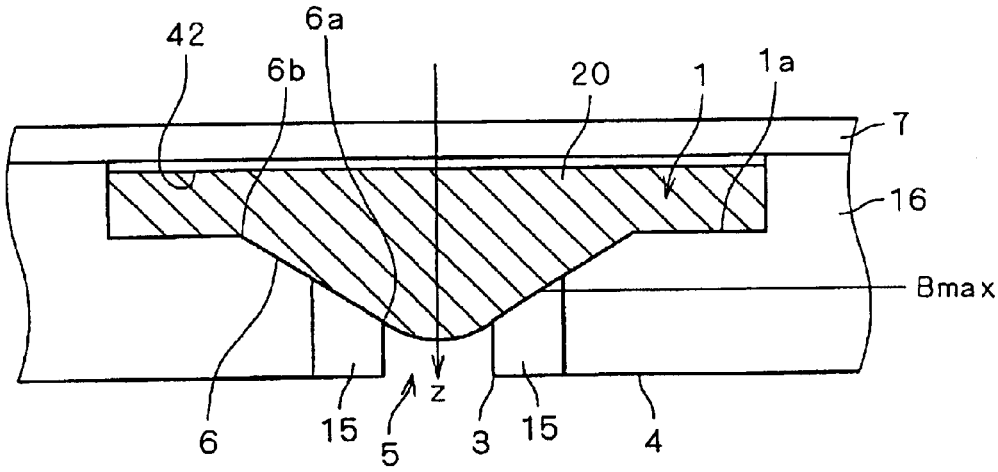
FIG. 21 is a cross-sectional view showing the structure of a nozzle according to a sixth preferred embodiment of the invention.

FIG. 21 is a cross-sectional view of a nozzle 106 according to a sixth preferred embodiment of the invention, which shows the structure appearing in a section parallel to the ejecting direction Z. Like the nozzle 105, the nozzle 106 is formed of a solder-philic first plate 16 and a second plate 15 bonded together. However, the nozzle 106 differs from the nozzle 105 in the position of the first plate 16 and the second plate 15. That is to say, the first plate 16 surrounds the second plate 15, with the second plate 15 forming the straight portion 5 and the opening 3. The nozzle exit surface 4 is formed by the second plate 15 in the vicinity of the opening 3 and by the first plate 16 in the part around it.

In the nozzle 106, as in the nozzle 105, the boundary between the first plate 16 and the second plate 15 is located, on the surface with which the molten solder 20 contacts, between the position Bmax and the bottom surface 1*a* of the molten solder chamber 1. This preferred embodiment thus provides the same effects as the fifth preferred embodiment.

The molten solder chamber 1 and the tapered portion 6 and straight portion 5 may be processed after the second plate 15 has been incorporated in the first plate 16, or the first plate 16 and the second plate 15 may be individually processed before put together.

Seventh Preferred Embodiment

Figure 22:
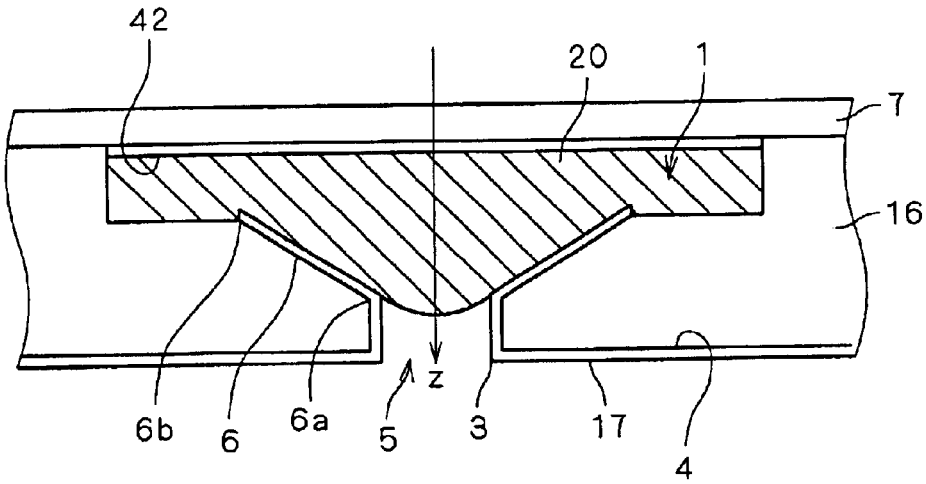
FIG. 22 is a cross-sectional view showing the structure of a nozzle according to a seventh preferred embodiment of the invention.
Figure 23:
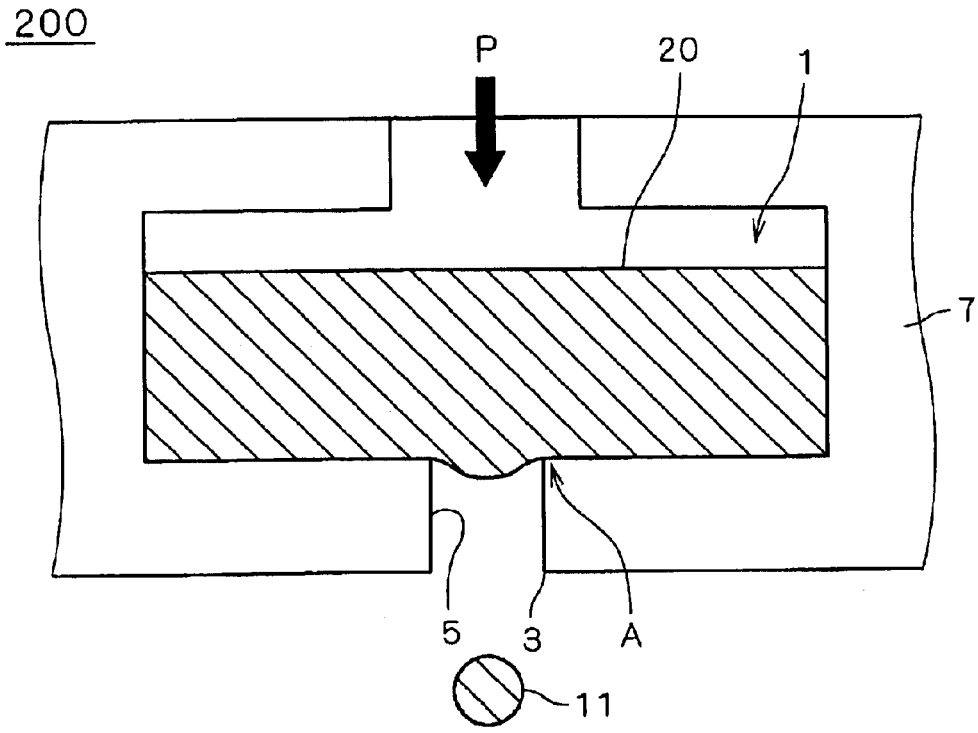
FIG. 23 (PRIOR ART)
FIGS. 23, 24, 25, 26 and 27 are cross-sectional views illustrating conventional arts.

FIG. 22 is a cross-sectional view of a nozzle 107 according to a seventh preferred embodiment of the invention, which shows the structure appearing in a section parallel to the ejecting direction Z. The nozzle 107 has the molten solder chamber 1, the tapered portion 6 communicating therewith, and the straight portion 5 communicating with the tapered portion 6. The tapered portion 6 has the edges 6*a* and 6*b* which adjoin the straight portion 5 and the molten solder chamber 1, respectively. The straight portion 5 has the opening 3 in the nozzle exit surface 4. As in the nozzle 101, the tapered portion 6 satisfies Expression (7). The straight portion 5 may be tapered off with respect to the ejecting direction Z at an angle β which satisfies Expression (9), or it may be spread out with respect to the ejecting direction Z, more preferably spread at an angle γ which satisfies Expression (10). The nozzle 107 is made of a solder-philic material, e.g. nickel. The molten solder chamber 1, the straight portion 5, and the tapered portion 6 can be formed by machining.

The molten solder chamber 1 is covered by the diaphragm 7 lying opposite the bottom surface 1*a*, where the molten solder 20 is stored with the molten solder chamber 1 and the diaphragm 7 enclosing it. While the solder-philic layer 42 is provided on the surface of the diaphragm 7 that faces to the bottom surface 1*a*, the solder-philic layer 42 can be removed when the diaphragm 7 is made of a solder-philic member. The molten solder 20 can thus be stored in the molten solder chamber 1 with good wettability and voids 40 (see FIG. 27) will not remain in the molten solder chamber 1 when the molten solder chamber 1 is first charged with the molten solder 20.

A solder-repellent layer 17 is formed on the nozzle exit surface 4, the straight portion 5, and the tapered portion 6. The solder-repellent layer 17 can be formed by coating using ceramics or diamond-like-carbon, or by chromium plating.

The solder-repellent surface and the solder-philic surface are thus positioned like those in the nozzle 101 and the nozzle 107 provides the same effects as the first preferred embodiment. Needless to say, similarly to the nozzle 102, the solder-repellent layer 17 may be formed to partially cover the tapered portion 6, as long as it extends from the opening 3, through the straight portion 5 and the edge 6*a*, and past the position B. The straight portion 5 may be removed, as in the nozzle 103.

The solder-repellent layer 17 has poor wettability with respect to the molten solder 20 and therefore it ensures steady ejecting operation for a long time, without being eroded by the molten solder 20.

However, the structure in which a solder-repellent body presents the solder-repellent surface and the solder-philic layer 43, provided thereon, presents the solder-philic surface, as shown in the nozzles 101 to 104 of the first to fourth preferred embodiments, is more desirable. This is because the solder-repellent layer 17 might be damaged by cleaning to the nozzle exit surface 4. When it is damaged, the molten solder 20, when ejected, will overflow onto the nozzle exit surface 4 to make the ejecting operation unsteady. The nozzles 101 to 104 will provide more steady ejecting operation because the part where the peripheral edge of the liquid surface is located is not surface-treated and therefore the solder repellent property will not be deteriorated in that part.

While the invention has been described in detail, the foregoing description is in all aspects illustrative and not restrictive. It is understood that numerous other modifications and variations can be devised without departing from the scope of the invention.

What is claimed is:

1. A nozzle for ejecting a molten metal in an ejecting direction, comprising:

a metal-philic surface on which a molten metal forms a contact angle smaller than 90°; and a metal-repellent surface on which the molten metal forms a contact angle larger than 90°, said metal-repellent surface being located forward of said metal-philic surface relative to an ejecting direction, wherein, before ejecting the molten metal from said nozzle, said nozzle holds a peripheral edge of a liquid surface of said molten metal at a position further forward in the ejecting direction than a boundary between said metal-philic surface and said metal-repellent surface.

2. The nozzle according to claim 1, wherein, the molten metal remaining in said nozzle, after molten metal has been ejected from said nozzle, is drawn back in a direction opposite the ejecting direction, so the peripheral edge of the liquid surface of the molten metal is located further forward in the ejecting direction than said boundary between said metal-philic surface and said metal-repellent surface.

3. The nozzle according to claim 2, further comprising, a first inner side surface which is, in a section including the ejecting direction, tapered in the ejecting direction at a first angle with respect to the ejecting direction, and a second inner side surface connecting with said first inner side surface in a position forward in the ejecting direction, said second inner side surface being tapered in the ejecting direction at a second angle with respect to the ejecting direction, wherein a boundary between said first inner side surface and said second inner side surface is located further forward in the ejecting direction than said boundary between said metal-philic surface and said metal-repellent surface, the first angle is not less than an angle obtained by subtracting 90° from a contact angle that the molten metal forms with respect to said metal-repellent surface on said first inner side surface, and the second angle is smaller than an angle obtained by subtracting 90° from the contact angle that the molten metal forms with respect to said second inner side surface.

4. The nozzle according to claim 3, wherein the first angle is no larger than 180°, and said nozzle further comprises a molten metal chamber for storing molten metal, said molten metal chamber having said metal-philic surface and being located rearward of said first inner side surface relative to the ejecting direction.

5. The nozzle according to claim 2, further comprising:

a first inner side surface which is, in a section including the ejecting direction, tapered in the ejecting direction at a first angle with respect to the ejecting direction, and a second inner side surface connecting with said first inner side surface in a position forward in the ejecting direction, said second inner side surface being parallel to the ejecting direction, wherein a boundary between said first inner side surface and said second inner side surface is located further forward in the ejecting direction than said boundary between said metal-philic surface and said metal-repellent surface, the first angle is not less than an angle obtained by subtracting 90° from a contact angle that the molten metal forms with respect to said metal-repellent surface on said first inner side surface, and the second angle is smaller than an angle obtained by subtracting 90° from the contact angle that the molten metal forms with respect to said second inner side surface.

6. The nozzle according to claim 5, wherein said first angle is no larger than 180°, and said nozzle further comprises a molten metal chamber for storing molten metal, said molten metal chamber having said metal-philic surface and being located rearward of said first inner side surface relative to the ejecting direction.

7. The nozzle according to claim 2, further comprising, a first inner side surface which is, in a section including the ejecting direction, tapered in the ejecting direction at a first angle with respect to the ejecting direction, and a second inner side surface connecting with said first inner side surface in a position forward in the ejecting direction, said second inner side surface being reverse tapered in the ejecting direction at a second angle with respect to the ejecting direction, wherein a boundary between said first inner side surface and said second inner side surface is located further forward in said ejecting direction than the boundary between said metal-philic surface and said metal-repellent surface, the first angle is not less than an angle obtained by subtracting 90° from a contact angle that the molten metal forms with respect to said metal-repellent surface on said first inner side surface, and the second angle is not smaller than an angle obtained by subtracting from 180° the contact angle that the molten metal forms with respect to said second inner side surface.

8. The nozzle according to claim 7, wherein said first angle is no larger than 180°, and said nozzle further comprises a molten metal chamber for storing molten metal, said molten metal chamber having said metal-philic surface and being located rearward of said first inner side surface relative to the ejecting direction.

9. The nozzle according to claim 1, comprising:

a metal-repellent body having said metal-repellent surface, and a metal-philic layer on said metal-repellent body and having said metal-philic surface.

10. The nozzle according to claim 9, wherein the molten metal is molten solder and said metal-philic layer comprises a plated layer containing nickel.

11. The nozzle according to claim 10, wherein said metal-philic layer further comprises a plated solder layer on said plated layer.

12. The nozzle according to claim 1, comprising a metal-repellent body having said metal-repellent surface and a metal-philic body having said metal-philic surface.

13. The nozzle according to claim 1, comprising a metal-philic body having said metal-philic surface and a metal-repellent layer on said metal-philic body and having said metal-repellent surface.

* * * * *